US012565290B1

(12) United States Patent
Gable et al.

(10) Patent No.: US 12,565,290 B1
(45) **Date of Patent: *Mar. 3, 2026**

(54) SYSTEM AND METHOD FOR CONTROLLING HEADING OF A MARINE VESSEL HAVING TRIM TABS

(71) Applicant: Brunswick Corporation, Mettawa, IL (US)

(72) Inventors: Kenneth G. Gable, Oshkosh, WI (US); Samuel E. Rustan, Pickett, WI (US); Ryan M. Trost, Oshkosh, WI (US); Steven J. Andrasko, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 296 days.

This patent is subject to a terminal disclaimer.

(21) Appl. No.: 18/349,667

(22) Filed: Jul. 10, 2023

(51) Int. Cl.

| | |
|---|---|
| ***B63B 1/30*** | (2006.01) |
| ***B63B 1/26*** | (2006.01) |
| ***B63B 79/40*** | (2020.01) |
| ***B63H 25/04*** | (2006.01) |
| *B63B 79/10* | (2020.01) |
| *B63H 25/02* | (2006.01) |

(52) U.S. Cl.
CPC ..... *B63B 1/30* (2013.01); *B63B 1/26* (2013.01); *B63B 79/40* (2020.01); *B63H 25/04* (2013.01); *B63B 79/10* (2020.01); *B63H 2025/022* (2013.01)

(58) Field of Classification Search
CPC .. B63B 1/30; B63B 1/26; B63B 79/40; B63B 79/10; B63B 43/00; B63B 79/30; B63B 2035/007; B63B 35/00; G05B 23/0275; G05B 9/02; G05B 2219/14006; B63H 25/04; B63H 21/21; B63H 2025/022; G05D 1/0206; G08G 3/02
See application file for complete search history.

(56) References Cited

U.S. PATENT DOCUMENTS

| | | | |
|---|---|---|---|
| 6,354,237 | B1 | 3/2002 | Gaynor et al. |
| 6,583,728 | B1 | 6/2003 | Staerzl |
| 7,188,581 | B1 | 3/2007 | Davis et al. |
| 8,480,445 | B2 | 7/2013 | Morvillo |
| 9,278,740 | B1 * | 3/2016 | Andrasko ..... G05D 1/0875 |

(Continued)

OTHER PUBLICATIONS

Sethuramalingam et al., Design model on ship trajectory control using particle swarm optimisation, 2015, IEEE, p. 1-6 (Year: 2015).*

(Continued)

*Primary Examiner* — McDieunel Marc
(74) *Attorney, Agent, or Firm* — Andrus Intellectual Property Law, LLP

(57) ABSTRACT

A method for controlling a heading of a marine vessel having first and second trim tabs and at least one marine drive is provided. The method includes obtaining first and second deployments of the first and second trim tabs, obtaining a speed of the marine vessel, and determining an expected yaw value based on the first and second deployments and the speed of the marine vessel. The method further includes determining a steering angle compensation based on the expected yaw rate value, and controlling steering of the at least one marine drive based on the steering angle compensation.

20 Claims, 6 Drawing Sheets

(56) References Cited

U.S. PATENT DOCUMENTS

| | | | | |
|---|---|---|---|---|
| 9,745,036 | B2 | 8/2017 | Andrasko et al. | |
| 10,011,339 | B2 * | 7/2018 | Anschuetz | B63H 20/10 |
| 12,065,230 | B1 * | 8/2024 | Derginer | B63H 20/12 |
| 12,124,276 | B2 * | 10/2024 | Chan | G05D 1/0875 |
| 12,134,454 | B1 * | 11/2024 | Derginer | G05D 1/0206 |
| 12,312,052 | B1 * | 5/2025 | Farrell | B63B 39/06 |
| 12,326,735 | B2 * | 6/2025 | Gallagher | B63B 1/322 |
| 2016/0375973 | A1 * | 12/2016 | Andrasko | G05D 1/0875 440/1 |

OTHER PUBLICATIONS

Fossen et al., Kalman filtering for positioning and heading control of ships and offshore rigs, 2009, IEEE, p. 1-15 (Year: 2009).*

Das et al., Robust Steering Autopilot Design for Marine Surface Vessels, 2016, IEEE, p. 913-922 (Year: 2016).*

Yang et al., Robust heading control and its application to Ciscrea Underwater Vehicle, 2015, IEEE, p. 1-6 (Year: 2015).*

* cited by examiner

SYSTEM AND METHOD FOR CONTROLLING HEADING OF A MARINE VESSEL HAVING TRIM TABS

FIELD

The present disclosure relates to systems and methods for controlling a heading of a marine vessel. Specifically, the present disclosure relates to controlling the heading of a marine vessel having at least first and second trim tabs attached to a rear of the marine vessel.

BACKGROUND

U.S. Pat. No. 6,354,237 discloses a trim tab control system in which four buttons or switches are provided for the marine operator in which the operator can select to raise the bow, raise the stern, raise the port side of the boat, or raise the stern side of the boat in relative terms, and the system will automatically position the trim tabs to most efficiently achieve the operator's demanded change in position of the marine vessel.

U.S. Pat. No. 9,278,740 discloses a system for controlling an attitude of a marine vessel having first and second trim tabs includes a controller having vessel roll and pitch control sections. The pitch control section compares an actual vessel pitch angle to a predetermined desired vessel pitch angle and outputs a deployment setpoint that is calculated to achieve the desired pitch angle. The roll control section compares an actual vessel roll angle to a predetermined desired vessel roll angle, and outputs a desired differential between the first and second deployments that is calculated to maintain the vessel at the desired vessel roll angle. When the controller determines that the magnitude of a requested vessel turn is greater than a first predetermined threshold, the controller decreases the desired differential between the first and second deployments, and accounts for the decreased desired differential deployment in its calculation of the first and second deployments.

U.S. Pat. No. 9,733,645 discloses a system and method for controlling handling of a marine vessel having a steerable component that is steerable to a plurality of positions to vary a direction of movement of the vessel. A controller is communicatively connected to an actuator of the steerable component and a user input device provides to the controller an operator-initiated steering command to steer the steerable component to one of the plurality of positions. A sensor provides to the controller an indication of an undesired course change of the marine vessel. The controller has a vessel direction control section that outputs a command to the actuator to change a position of the steerable component from the one of the plurality of positions so as to automatically counteract the undesired course change. The vessel direction control section is active only when the operator-initiated steering command is less than or equal to a predetermined threshold.

U.S. Pat. No. 9,745,036 discloses a trim control system that automatically controls trim angle of a marine propulsion device with respect to a vessel. A memory stores trim base profiles, each defining a unique relationship between vessel speed and trim angle. An input device allows selection of a base profile to specify an aggressiveness of trim angle versus vessel speed, and then optionally to further refine the aggressiveness. A controller then determines a setpoint trim angle based on a measured vessel speed. If the user has not chosen to refine the aggressiveness, the controller determines the setpoint trim angle from the selected base profile. However, if the user has chosen to refine the aggressiveness, the controller determines the setpoint trim angle from a trim sub-profile, which defines a variant of the relationship between vessel speed and trim angle defined by the selected base profile. The control system positions the propulsion device at the setpoint trim angle.

Each of the above patents is hereby incorporated herein by reference in its entirety.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one aspect of the present disclosure, a method for controlling a heading of a marine vessel having first and second trim tabs and at least one marine drive is provided. The method includes obtaining first and second deployments of the first and second trim tabs, obtaining a speed of the marine vessel, and determining an expected yaw value based on the first and second deployments and the speed of the marine vessel. The method further includes determining a steering angle compensation based on the expected yaw rate value, and controlling steering of the at least one marine drive based on the steering angle compensation.

According to another aspect of the present disclosure, a system for controlling a heading of a marine vessel is provided. The system includes at least one marine drive configured to propel a marine vessel, a steering actuator configured to rotate at least a portion of the marine drive about a steering axis, first and second trim tabs, and first and second trim tab actuators configured to actuate the first and second trim tabs to first and second deployments, respectively. The system further includes a control system configured to obtain the first and second deployments of the first and second trim tabs, obtain a speed of the marine vessel, and determine an expected yaw rate value based on the first and second deployments and the speed of the marine vessel. The control system is further configured to determine a steering angle compensation based on the expected yaw rate value, and implement the steering angle compensation using the at least one marine drive to modify the heading of the marine vessel.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed.

Trim tabs are known in the art of marine vessels as actuatable surfaces that may be provided on the transom of a marine vessel to help adjust the running angle of the vessel. By controlling the actuation of such tabs, a vessel can get on plane faster, and unwanted pitch and roll movements of the vessel can be corrected. However, through research and development, the present inventors have realized that when controlling a marine vessel's attitude using trim tabs, the vessel handling may be adversely affected in certain scenarios. Particularly, when the trim tabs of a vessel are deployed to different positions, for example, the first trim tab is deployed to 25% of a full range of movement from a horizontal position and the second trim tab is deployed to 35%, a yaw effect is induced on the marine vessel that must be corrected either by a manual steering input by a user or an autopilot operation to bring the heading back into alignment with a target heading. Either correction option is undesirable because it is reactionary, requiring a heading change to first occur and then be corrected.

Further, if the vessel is controlled by the operator using manual steering, the operator must constantly remain on alert to provide yaw corrections because the trim tabs are deployed automatically to control roll of the vessel, and therefore the induced yaw may be unpredictable. If the vessel is under autopilot operation, the induced yaw will tend to steer the vessel off-course, leading to instability and a less desirable boating experience. To the extent that the autopilot system is slow to detect such off-course movements, the user will experience significant heading corrections. On the other hand, where the autopilot system quickly corrects slight heading changes, the autopilot system may be too reactive and make unnecessary or inappropriate heading adjustments which may degrade the boating experience for the user. In view of the forgoing problems and challenges, the present inventors have therefore developed the disclosed system that automatically and proactively controls the heading of the vessel when yaw forces are induced by trim tabs to prevent an unwanted heading change from occurring.

Figure 1:
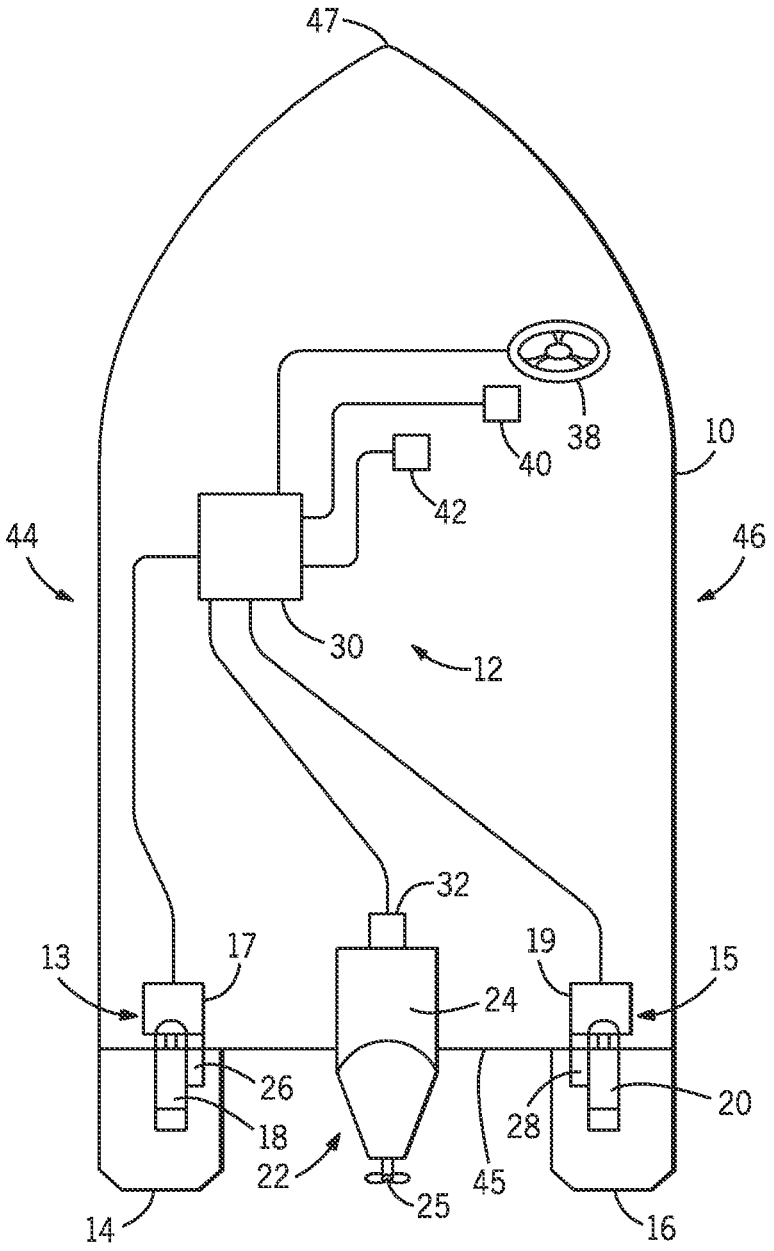
FIG. 1 illustrates a marine vessel according to the present disclosure.

FIG. 1 illustrates a marine vessel 10 having a control system 12 for controlling a heading of the marine vessel 10. The marine vessel 10 has first and second trim tabs 14, 16. Although in the example shown the trim tab 14 is a port trim tab and the trim tab 16 is a starboard trim tab, the orientation of the trim tabs 14, 16 and their designation as first and second need not correspond. In other words, the port trim tab need not be the first trim tab, and the starboard trim tab need not be the second trim tab, i.e., the designations as "first" and "second" could be reversed. In further embodiments, in place of or in addition to the trim tabs 14, 16, the marine vessel 10 may include trim deflectors or interceptors. The systems and methods disclosed herein may be similarly implemented by trim deflectors or interceptors.

The trim tab 14 is actuated by a trim tab actuator 13 and the trim tab 16 is actuated by a trim tab actuator 15. Marine vessel 10 includes at least one propulsion module 22, which may be, for example, a pod drive, inboard drive, or other type of stern drive. The propulsion module 22 has an engine 24 that turns a propeller 25 to produce a thrust to propel the marine vessel 10 in a generally forward direction. In various embodiments, the engine 24 may be an electric motor. The propulsion module 22 is capable of rotating around a generally vertical axis by a steering actuator 32 in response to commands originating from a steering wheel 38 or autopilot section 40 that may be modified and transmitted to the steering actuator 32 by the control system 12. Also included on the marine vessel 10 are trim tab sensors 26, 28, for sensing a position of the trim tabs 14, 16. For example, these sensors 26, 28 may be Hall Effect sensors.

The control system 12 for controlling an attitude of the marine vessel 10 further includes a controller 30. The controller 30 may be representative of one or multiple controllers (drive controllers, steering controllers, tab controllers, etc.) that are configured to execute the claimed methods and control functions of the present invention. The controller 30 has a memory and a programmable processor. As is conventional, the processor can be communicatively connected to a computer readable medium that includes volatile or nonvolatile memory upon which computer readable code is stored. The processor can access the computer readable code and the computer readable medium upon executing the code carries out the functions as described herein. In the example shown, the controller 30 is connected to the trim tab actuators 13, 15; the propulsion module 22; and the trim tab sensors 26, 28 via wired connections. However, it should be understood that these devices could be connected in other ways, such as, for example, wirelessly or through a wired network such as a CAN bus. In the example shown, the steering wheel 38, the autopilot section 40, and a pitch/roll sensor 42 are also connected to the controller 30. In one example, the pitch/roll sensor 42 is an attitude and heading reference system (AHRS) that provides 3D orientation of the marine vessel 10 by integrating gyroscopic measurements, accelerometer data, and magnetometer data. A gyroscope, motion reference unit (MRU), tilt sensor, inertial measurement unit (IMU), or any combination of these devices could instead be used. In another example, two separate sensors are provided for sensing pitch and roll of the marine vessel 10.

Trim tabs 14 and 16 are connected to the transom 45 of the marine vessel 10. These trim tabs 14 and 16 are designed to pivot. To put the bow 47 of the marine vessel 10 down, both trim tabs 14 and 16 are moved down to the maximum lowered position, or "trimmed-in" position. For low power or trailing operation, the trim tabs 14 and 16 are lifted to the maximum raised position, or "trimmed-out" position or zero degree position.

As mentioned, the marine vessel 10 is provided with first and second trim tab actuators 13, 15. The first actuator 13 may comprise a hydraulic cylinder 18 connected to an electro-hydraulic motor or pump 17. The hydraulic cylinder 18 operates to rotate the first trim tab 14 to the trimmed-out or zero degree position and the trimmed-in position and to maintain the trim tab 14 in any desired position. Similarly, the second actuator 15 may comprise a hydraulic cylinder 20 connected to an electro-hydraulic motor or pump 19. The hydraulic cylinder 20 operates to rotate the second trim tab 16 to the trimmed-out or zero degree position and the trimmed-in position and to maintain the trim tab 16 in any desired position. Other types of actuators 13, 15 could be used in other examples.

Figure 2:
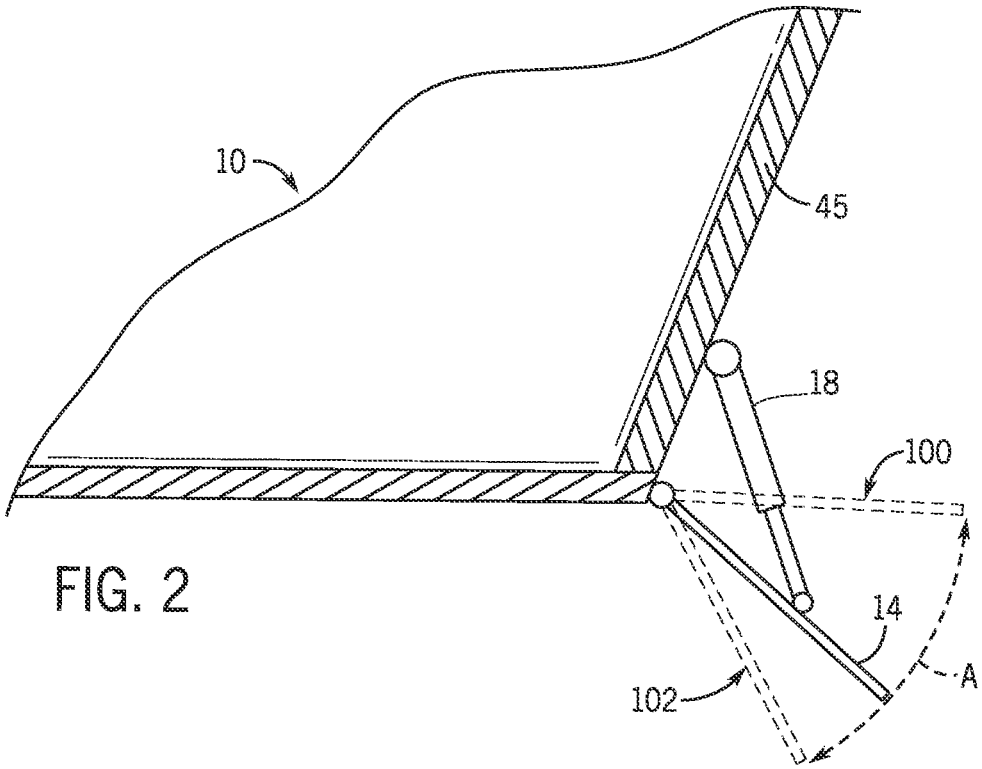
FIG. 2 illustrates a side view of a trim tab and various positions to which the trim tab may be actuated.

Those having ordinary skill in the art will appreciate that the trim tabs 14 and 16 can be actuated to different deployments with respect to the transom 45 of the marine vessel 10. With reference to FIG. 2, for example, the trim tabs 14, 16 can be deployed from 0% deployment where they project generally horizontally (position 100), to 100% deployment, where they lie at a calibrated maximum angle A with respect to horizontal (position 102). The calibrated maximum angle A at which the trim tabs 14, 16 are considered 100% deployed can vary based on the specifics of the marine vessel 10 to which the trim tabs 14, 16 are attached. In accordance with the nomenclature provided herein, the trim tabs 14, 16 are less deployed when they lie closer to horizontal (position 100) and are more deployed when they extend at increasingly greater angles to horizontal.

Figure 3:
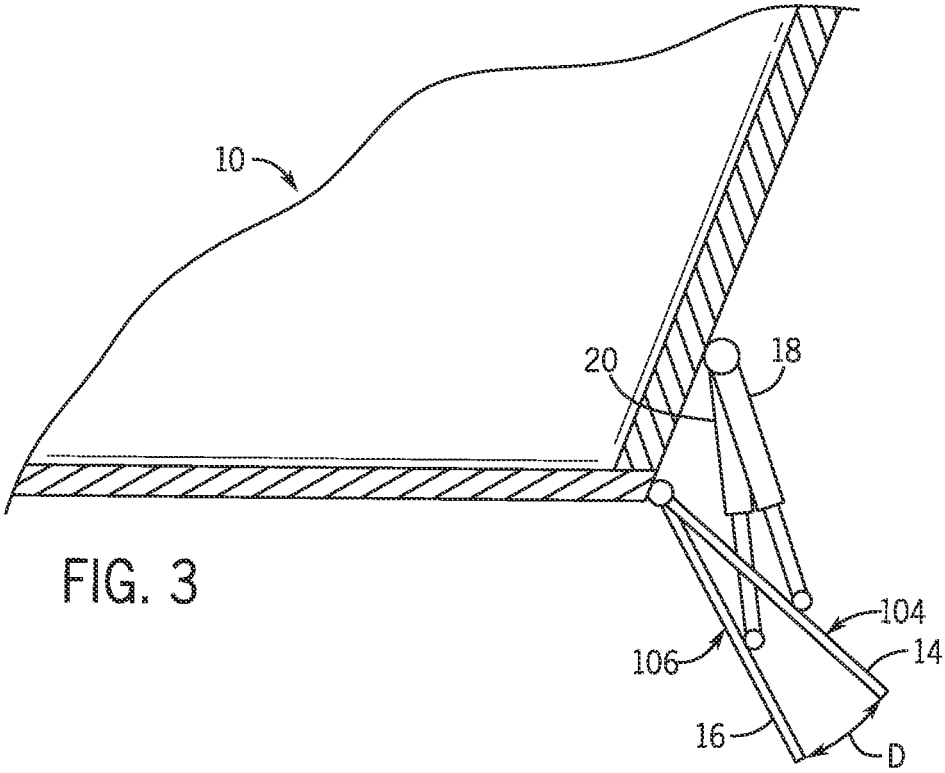
FIG. 3 illustrates a side view of first and second trim tabs having differential deployment.

At times, it is desirable to deploy one of the trim tabs 14, 16 more or less than the other of the trim tabs 14, 16 in order to affect an attitude of the marine vessel 10. In doing so, the trim tabs 14, 16 will have a "differential" in their deployments, in that one of the trim tabs will be deployed at a value from 0 to 100% that is different than the value of deployment (from 0 to 100%) of the other of the trim tabs. For example, referring to FIG. 3, trim tab 14 might be at position 104, while trim tab 16 might be at position 106, creating a differential deployment of D. This differential deployment D can, for example, be quantified in terms of a percent deployment difference or as an angular difference, it being understood that the units by which deployment is measured are not limiting on the scope of the present disclosure. Differential deployment of the trim tabs 14, 16 may be desirable if, for example, a strong wind is blowing from the port side 44 of the marine vessel 10, causing the marine vessel to list to starboard 46. In response, the control system 12 may automatically deploy the trim tab 16 on the starboard side 46 of the marine vessel 10 such that is more deployed than the trim tab 14 on the port side 44. Deploying the trim tab 16 more than the trim tab 14 creates a greater upwardly directed force under the starboard side 46 of the marine vessel 10, due to an increased angle of attack of water on the trim tab 16. The greater force caused by the differential deployment lifts the starboard side 46 of the marine vessel 10 and rolls the vessel to port 44, thereby countering the list to starboard 46.

At other times, it may be desirable to purposely pitch the marine vessel 10 in a way that the marine vessel 10 would not otherwise be pitched were it not for deployment of the trim tabs 14, 16. For instance, if the marine vessel 10 is pitching fore or aft due to the effect of wind or waves, it may be desirable to deploy the trim tabs 14, 16 in a manner to counter this externally induced pitch. For example, if the marine vessel 10 is pitching in a backward direction, it may be desirable to increase the deployment of both trim tabs 14, 16 in order to increase the upward force on the stern (provided by the increased angle of the trim tabs) and thereby lower the bow 47 of the marine vessel 10. One example of when this type of control is needed is when the marine vessel 10 switches from operating at maximum speed, with tabs fully up, to barely planning speed. After the operator reduces the throttle, the pitch controller will increment the tabs to a more deployed state so as to keep the bow of the vessel down. Generally, in order to counter only externally induced pitch of a marine vessel 10, it is not necessary to differentially deploy the trim tabs 14, 16; rather, both trim tabs 14, 16 may be deployed to the same setpoint deployment, measured from horizontal.

Figure 4:
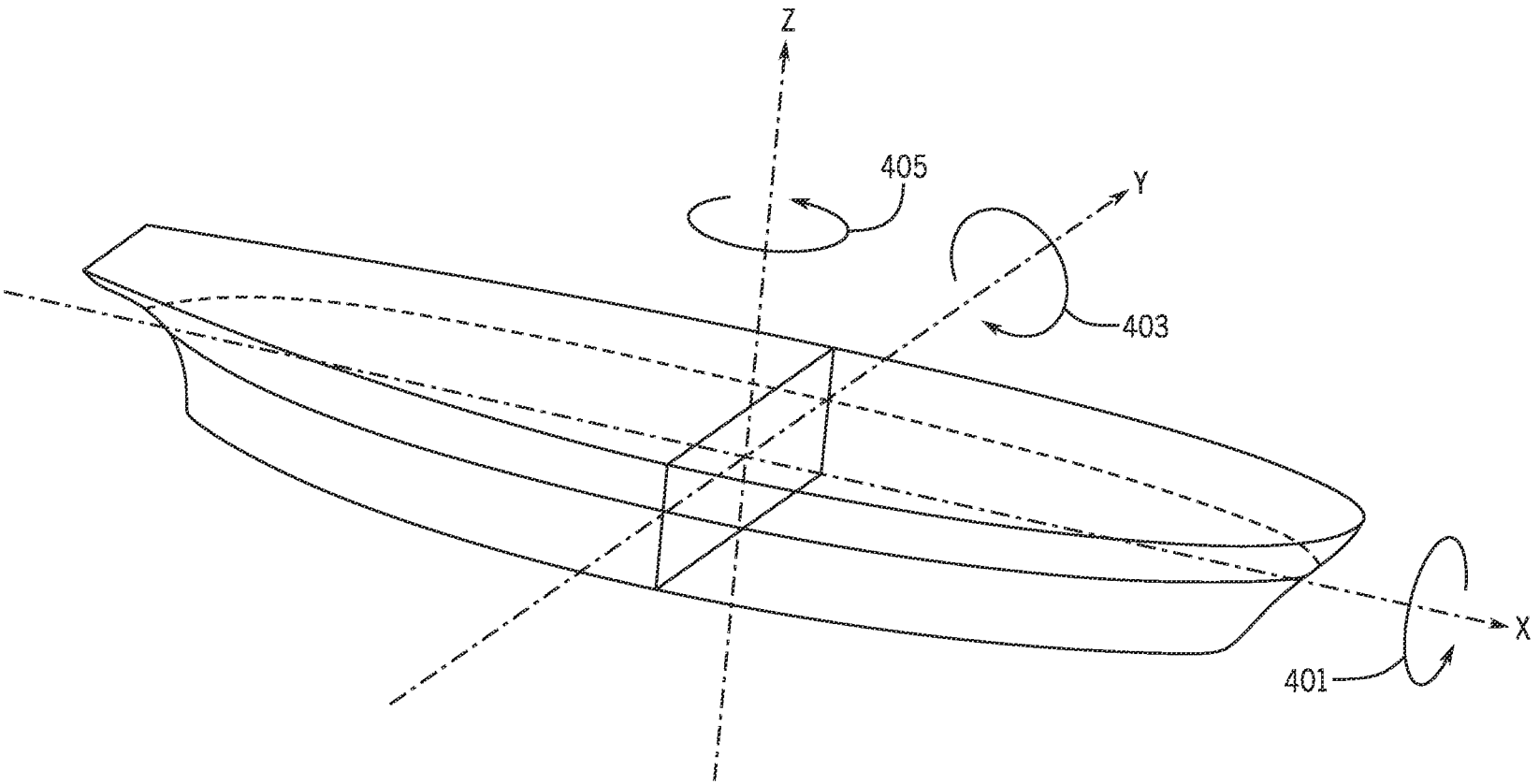
FIG. 4 illustrates a marine vessel and a coordinate system for defining movement and attitude of the marine vessel.

With reference to FIG. 4, a marine vessel's attitude can be described by its roll around an x-axis, its pitch around a y-axis, and its yaw around a z-axis. Roll error can be calculated by an angular difference from a horizontal plane defined by the x- and y-axes. As used herein, a positive roll error is around the x-axis in the direction of the arrow 401 shown in FIG. 4. A negative roll error is in the opposite direction. As used herein, a positive pitch error is around the y-axis in the direction of the arrow 403 shown in FIG. 4. A negative pitch error is in the opposite direction. A positive yaw error is around the z-axis in the direction of the arrow 405 shown in FIG. 4. A negative yaw error is in the opposite direction.

Referring back to FIG. 1, the present disclosure thereby provides for a control system 12 for controlling a heading of a marine vessel 10 having first and second trim tabs 14, 16. The system 12 comprises a controller 30 and first and second trim tab actuators 13, 15 in signal communication with the controller 30 that actuate the first and second trim tabs 14, 16 to first and second deployments. In one example, the first and second deployments are percentage values of a maximum angle of deployment from horizontal. In another example, the first and second deployments are values representing the angles from horizontal themselves. The system 12 further comprises a roll sensor that provides an actual vessel roll angle to the controller 30, a pitch sensor that provides an actual vessel pitch angle to the controller 30, and a yaw sensor that provides an actual vessel yaw angle to the controller 30. In the example shown, the roll sensor, the pitch sensor, and the yaw sensor are combined into one roll/pitch/yaw sensor 42.

The controller 30 of the control system 12 compares the actual vessel pitch angle to a predetermined desired vessel pitch angle, and outputs a deployment setpoint for the trim tabs 14, 16 that is calculated to achieve the desired pitch angle. In one example, the desired vessel pitch angle is close to zero, such that the marine vessel 10 is generally level with respect to the surface of a body of water in which it is operating (i.e., is not rotated around the y-axis of FIG. 4). As indicated above, the deployment setpoint is a calculated deployment from horizontal to which both the first and second trim tabs 14, 16 should be actuated in order to achieve the desired pitch angle and/or counter an externally-induced pitch of the marine vessel 10. The system 12 uses feedback from the trim tab sensors 26, 28 and the pitch/roll/yaw sensor 42 in order to determine whether the marine vessel 10 has achieved the desired pitch angle and whether the trim tabs 14, 16 are to be actuated more or less in order to achieve such desired pitch angle.

Figure 5:
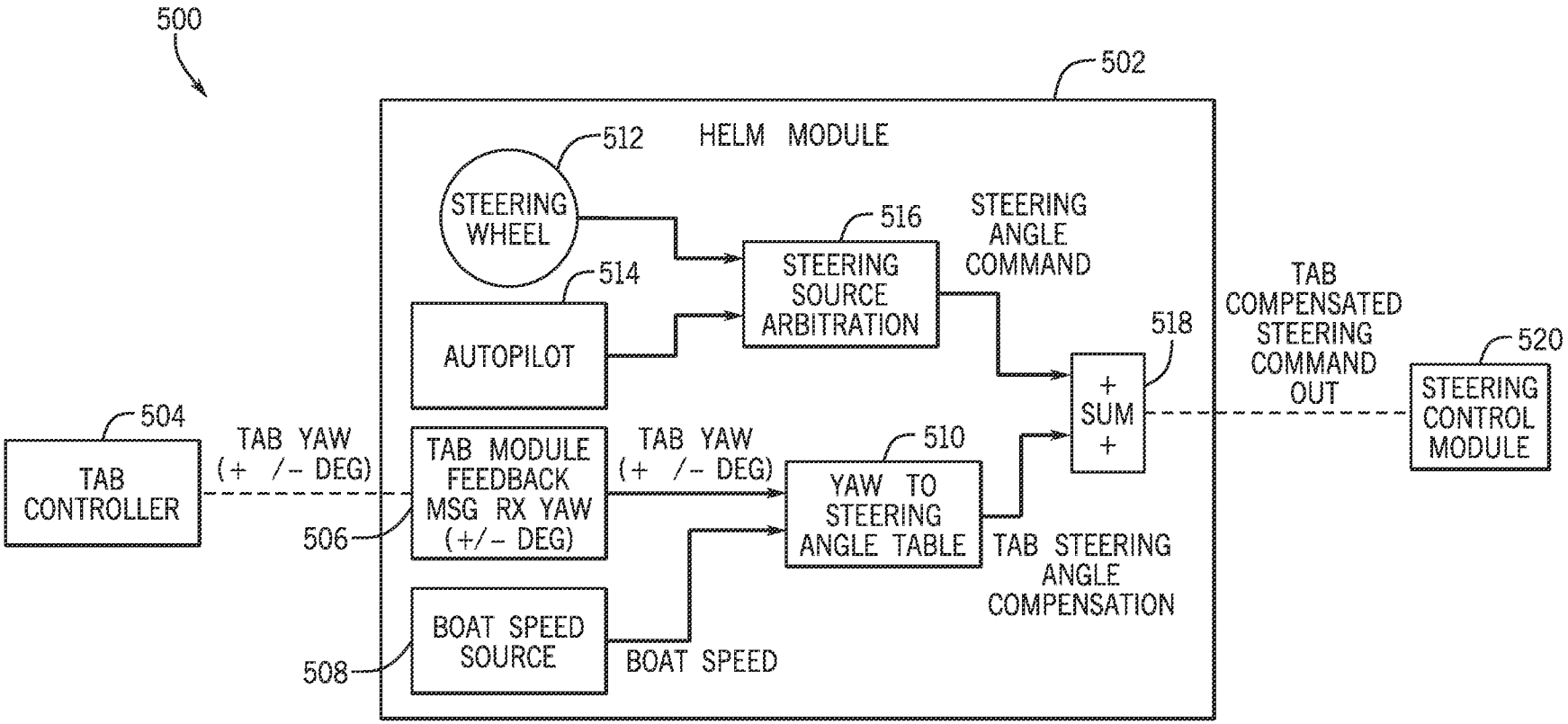
FIG. 5 illustrates a schematic diagram of an exemplary embodiment of a heading control system according to the present controller.
Figure 6:
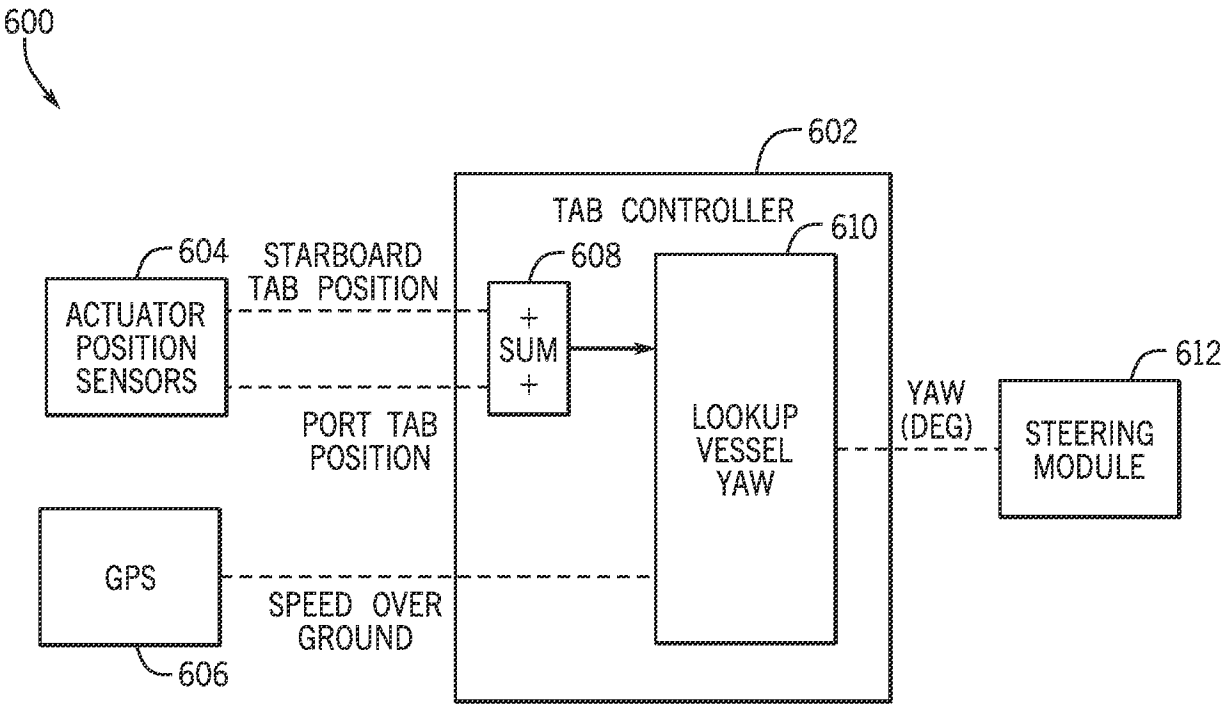
FIG. 6 illustrates a schematic diagram of another exemplary embodiment of a heading control system according to the present controller.

Turning now to FIGS. 5 and 6, exemplary embodiments of the control system 12 configured to control a heading of the marine vessel 10 according to the present disclosure are provided. Such control arrangements are merely exemplary, and the logic disclosed herein may be distributed in various other arrangements among one or multiple controllers. FIG. 5 shows an exemplary system 500 that may include a helm module or controller 502. The helm controller 502 is shown to receive input from a tab module or controller 504. In an exemplary implementation, the tab controller 504 communicates with the first and second trim tab actuators 13, 15 to receive the first and second deployments of the trim tabs 14, 16. Based on the deployments and a measured speed of the vessel 10, the tab controller 504 calculates an expected yaw value induced by the tabs 14, 16. In various embodiments, the expected yaw value may be an expected yaw magnitude value (i.e., degrees), an expected yaw rate value (i.e., degrees per second), or an expected yaw acceleration value (i.e., degrees per second squared). The expected yaw values may be obtained using a variety of methods. For example, the expected yaw values may be obtained from physical test data, in which the trim tabs 14, 16 are deployed about their full ranges at a variety of vessel speeds, and the yaw values induced by the various deployments and speeds are measured. In other embodiments, the expected yaw values may be obtained from a hydrodynamic model of the vessel 10.

The expected yaw value is provided from the tab controller 504 to a tab module feedback controller 506 within the helm controller 502. The tab module feedback controller 506 handles the input of the expected yaw signal from the tab controller 504, for example, by converting an analog input signal to a digital output signal. In other embodiments, the controller 506 could receive and interpret messages from the tab controller 504 using controller area network (CAN), WiFi, or Bluetooth protocols. The output of the tab module feedback controller 506 is provided to a yaw to steering table 510, along with a speed of the vessel from a vessel speed source 508. The speed of the vessel may be obtained using any suitable method (e.g., GPS, pitot tube, paddle wheel), and is not particularly limited. As described in further detail below, determination of the speed of the vessel is important for embodiments where the speed of the vessel is correlated with an amount of yaw induced by differential deployment of the tabs 14, 16.

The yaw to steering table 510 correlates the expected yaw value and the speed of the vessel 10 and outputs a tab steering angle compensation value that is appropriate for the vessel's hull and steering system. In other embodiments, rather than a lookup table, the tab steering angle compensation value could be based on a torque that is calculated from various parameters of the marine vessel 10, for example, the drag forces created by the tabs 14, 16 and the distances of the tabs 14, 16 from a centerline of the vessel. The tab steering angle compensation value is provided as output to a summing block 518. The summing block 518 is additionally shown to receive input from a steering source arbitration controller 516. The steering source arbitration controller 516 may determine whether steering commands for the marine drive 24 are being received from a user input device (e.g., steering wheel 512) or generated by an autopilot controller 514. Based on the determination, the steering source arbitration controller 516 may output a steering angle command to the summing block 518. The summing block 518 is configured to apply the tab steering angle compensation value of the table 510 to the steering angle command output of the steering source arbitration 516 and provide a steering angle compensation to a steering control module or controller 520. In other words, if the steering source arbitration 516 indicates a manual steering heading correction of 10 degrees in a first direction, and the expected yaw output of the table 510 due to differential deployment of the tabs 14, 16 is 2 degrees in the same direction, the helm controller 502 will output a steering angle compensation 8 degrees heading change. The steering control module 520 may then command the steering actuator 32 (see FIG. 1) to rotate the marine drive 24 and effectuate the operator's tab compensated steering command.

Turning now to FIG. 6, a schematic diagram of a system 600 for controlling the heading of the marine vessel 10 according to another exemplary embodiment of the present disclosure is depicted. The system 600 is shown to include a tab controller 602 that is identical or substantially similar to the tab controller 504 depicted in FIG. 5. Tab controller 602 receives inputs from actuator position sensors 604 indicating the deployments of the trim tabs 14, 16. The deployment inputs are shown to be received at a summing block 608, which may be configured to compare and determine the differential between the deployments 14, 16. In some exemplary embodiments, the deployment inputs may include an average value of the deployments of the trim tabs 14, 16. For example, if the first trim tab 14 is deployed 25% and the second trim tab 16 is deployed 35%, an average tab deployment value of 30% along with only one of the positions of the tabs 14, 16. In addition to the utilization of the tab deployments and, in some instances, the tab differential, the yaw to steering table 610 further utilizes a vessel speed input from a vessel speed source 606 to determine an expected yaw value output due to differential deployment of the tabs 14, 16. As described above, the vessel speed source 606 may be any suitable instrument or sensor configured to determine the speed of the vessel 10, for example, a GPS system.

The expected yaw value output of the yaw to steering table 610, for example, an expected induced yaw magnitude expressed in degrees, may be provided as input to a steering control module 612. The steering control module 612 may be utilized to generate steering commands for the steering actuator 32 to compensate for heading changes induced by the tabs 14, 16. In an exemplary embodiment, the steering control module 612 is configured to perform the same functions as the helm controller 502 and the steering control module 520, described above with reference to FIG. 5.

Figure 7:
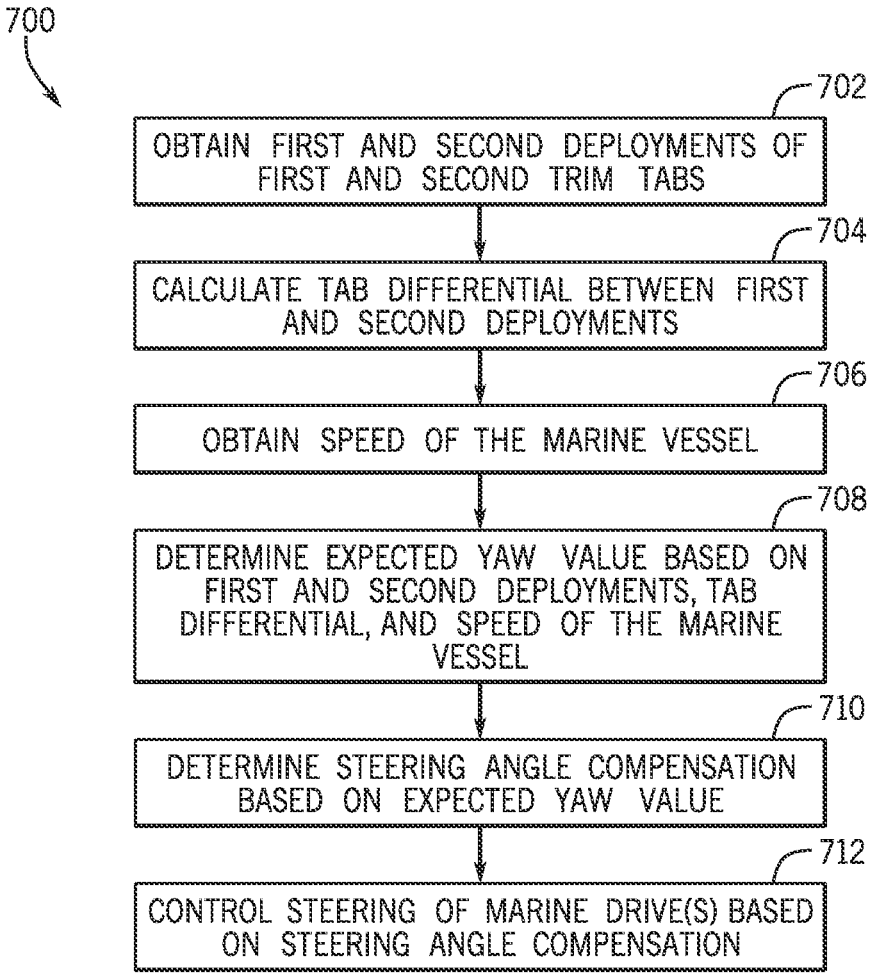
FIG. 7 illustrates a method for controlling a heading of the marine vessel according to the present disclosure.

Referring now to FIG. 7, a method 700 for controlling the heading of a marine vessel 10 having trim tabs 14, 15 is provided. In various embodiments, the method may be performed primarily by the system 12 depicted in FIG. 1, the system 500 depicted in FIG. 5, or the system 600 depicted in FIG. 6. For the purposes of simplicity, method 700 will described exclusively with reference to the controller 30 of system 12, but it could likewise be performed by various controllers in communication with each other, for example, the helm controller 502, tab controller 504, and steering controller 520 of FIG. 5.

Method 700 commences at step 702, in which the controller 30 obtains the deployments of the trim tabs 14, 16. As described above, the deployments of the trim tabs 14, 16 may be positions of the trim tabs 14, 16 expressed as percentages of full deployment from the horizontal. At step 704, the controller 30 calculates the differential between the deployments of the trim tabs 14, 16. In some instances, if the differential between the deployments of the trim tabs 14, 16 does not exceed a minimum tab differential threshold, method 700 concludes and the controller 30 does not proceed in calculating an expected yaw value because such induced yaw is very small or nonexistent.

At step 706, the controller 30 obtains the speed of the vessel 10. This is because the yaw induced by differential deployment of the trim tabs 14, 16 varies according to vessel speed. At low speeds (e.g., 5-10 mph), the induced yaw is smaller than when the vessel is traveling at moderate speed (e.g., 35-40 mph), however, once the speed exceeds a peak value (e.g., 70-80 mph), the vessel 10 is traveling fast enough that the tabs 14, 16 may be out of the water and the yaw induced by differential deployment is significantly reduced.

At step 708, the controller 30 determines the expected yaw value based on the deployments of the trim tabs 14, 16 obtained at step 702, the differential between the tab deployments calculated at step 704, and the speed of the vessel 10 obtained at step 706. At step 710. Method 700 concludes at step 712, as the controller 30 controls the steering of the marine drive 24 based on the steering angle compensation determined at step 710 by controlling a steering actuator 32 of the marine drive 24. In an exemplary embodiment, the steering angle compensation modifies a steering position associated with the steering command. In various embodiments, the steering command is received from a steering user input device (e.g., steering wheel 38) or is generated by an autopilot controller (e.g., autopilot 42).

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims. Each limitation in the appended claims is intended to invoke interpretation under 35 U.S.C. § 112(f), only if the terms "means for" or "step for" are explicitly recited in the respective limitation.

What is claimed is:

1. A method for controlling a heading of a marine vessel having first and second trim tabs and at least one marine drive, the method comprising:

obtaining, by a processor, first and second deployments of the first and second trim tabs;

obtaining, by a processor, a speed of the marine vessel;

determining, by the processor, an expected yaw value based on the first and second deployments and the speed of the marine vessel;

determining, by the processor, a steering angle compensation based on the expected yaw rate value; and controlling steering of the at least one marine drive based on the steering angle compensation.

2. The method of claim 1, wherein the expected yaw value is an expected yaw magnitude value.

3. The method of claim 1, wherein the expected yaw value is an expected yaw rate value.

4. The method of claim 1, wherein the expected yaw value is an expected yaw acceleration value.

5. The method of claim 1, wherein the method further comprises calculating a tab differential between the first and second deployments, wherein the expected yaw value is further based on the tab differential.

6. The method of claim 5, wherein the expected yaw value is determined responsive to the tab differential exceeding a minimum tab differential threshold.

7. The method of claim 1, wherein the expected yaw value is further based on a position of at least one of the first and second trim tabs.

8. The method of claim 1, further comprising controlling the steering of the at least one marine drive based further on a steering command, wherein the steering angle compensation modifies a steering position associated with the steering command.

9. The method of claim 8, wherein the steering command is based on input from a steering user input device.

10. The method of claim 8, wherein the steering command is generated by an autopilot operation.

11. A system for controlling a heading of a marine vessel, the system comprising:

at least one marine drive configured to propel a marine vessel;

a steering actuator configured to rotate at least a portion of the marine drive about a steering axis;

first and second trim tabs; and first and second trim tab actuators configured to actuate the first and second trim tabs to first and second deployments, respectively;

a control system configured to:

obtain, by a processor, the first and second deployments of the first and second trim tabs;

obtain, by the processor, a speed of the marine vessel;

determine, by the processor, an expected yaw rate value based on the first and second deployments and the speed of the marine vessel;

determine, by the processor, a steering angle compensation based on the expected yaw rate value; and implement the steering angle compensation using the at least one marine drive to modify the heading of the marine vessel.

12. The system of claim 11, wherein the expected yaw value is an expected yaw magnitude value.

13. The system of claim 11, wherein the expected yaw value is an expected yaw rate value.

14. The system of claim 11, wherein the expected yaw value is an expected yaw acceleration value.

15. The system of claim 11, wherein the control system is further configured to calculate a tab differential between the first and second deployments, wherein the expected yaw value is further based on the tab differential.

16. The system of claim 15, wherein the expected yaw value is determined responsive to the tab differential exceeding a minimum tab differential threshold.

17. The system of claim 11, wherein the expected yaw value is further based on a position of at least one of the first and second trim tabs.

18. The system of claim 11, wherein the control system is further configured to control the steering of the at least one marine drive based further on a steering command, wherein the steering angle compensation modifies a steering position associated with the steering command.

19. The system of claim 18, wherein the steering command is based on input from a steering user input device.

20. The system of claim 18, wherein the steering command is generated by an autopilot operation.

* * * * *